US010807105B2

(12) United States Patent
Rothman et al.

(10) Patent No.: US 10,807,105 B2
(45) Date of Patent: Oct. 20, 2020

(54) TUMBLER CELL FOR MINERAL RECOVERY USING ENGINEERED MEDIA

(71) Applicant: CiDRA Corporate Services LLC, Wallingford, CT (US)

(72) Inventors: Paul J. Rothman, Windsor, CT (US); Mark R. Fernald, Enfield, CT (US); Peter A. Amelunxen, Colebay (SX); Paul Dolan, Portland, CT (US); Timothy J. Bailey, Longmeadow, MA (US); Michael Ryan, Newtown, CT (US)

(73) Assignee: CiDRA CORPORATION SERVICES LLC, Wallingford, CT (US)

( * ) Notice: Subject to any disclaimer, the term of this patent is extended or adjusted under 35 U.S.C. 154(b) by 20 days.

(21) Appl. No.: 16/066,160

(22) PCT Filed: Dec. 28, 2016

(86) PCT No.: PCT/US2016/068843

§ 371 (c)(1),
(2) Date: Jun. 26, 2018

(87) PCT Pub. No.: WO2017/117200

PCT Pub. Date: Jul. 6, 2017

(65) Prior Publication Data

US 2019/0009280 A1 Jan. 10, 2019

Related U.S. Application Data

(60) Provisional application No. 62/405,569, filed on Oct. 7, 2016, provisional application No. 62/276,051, filed (Continued)

(51) Int. Cl.
*B03D 1/02* (2006.01)
*B03B 7/00* (2006.01)

(Continued)

(52) U.S. Cl.
CPC ..... *B03D 1/023* (2013.01); *B01F 9/00* (2013.01); *B01F 9/0007* (2013.01); *B03B 1/04* (2013.01); *B03B 7/00* (2013.01)

(58) Field of Classification Search
CPC ..... B03D 1/023; B01F 9/00; B01F 9/0007; B03B 1/04; B03B 7/00

(Continued)

(56) References Cited

U.S. PATENT DOCUMENTS 4,119,303 A * 10/1978 Kellerwessel ..... C22B 15/0091 266/170
4,511,461 A * 4/1985 Kruyer ..... B03B 1/04 209/166

(Continued)

FOREIGN PATENT DOCUMENTS

WO 2012162591 A1 11/2012

*Primary Examiner* — Terrell H Matthews
(74) *Attorney, Agent, or Firm* — Ware, Fressola, Maguire & Barber LLP

(57) ABSTRACT

Apparatus uses engineered collection media to recover mineral particles in a slurry. The apparatus has a tumbler cell and a rotation device to rotate the tumbler cell. The tumbler cell has a container to hold a mixture of the engineered media and the slurry containing the mineral particles. The container is turned such that at least part of the mixture in the upper part of the container is caused to interact with at least part of the mixture in the lower part of the container. As such, the contact between the engineered media and the mineral particles is enhanced. The surfaces of the engineered media are functionalized with a chemical having molecules to attract the mineral particles to the surfaces so as to form mineral laden media. After the mineral laden media are discharged from the tumbler cell, the mineral particles can be separated from the engineered media by stripping.

16 Claims, 10 Drawing Sheets

Related U.S. Application Data on Jan. 7, 2016, provisional application No. 62/272,026, filed on Dec. 28, 2015.

(51) Int. Cl.
*B03B 1/04* (2006.01)
*B01F 9/00* (2006.01)

(58) Field of Classification Search
USPC ..... 209/9, 45, 46, 47, 49
See application file for complete search history.

(56) References Cited

U.S. PATENT DOCUMENTS

| | | | | |
|---|---|---|---|---|
| 4,744,889 | A * | 5/1988 | Kruyer | B01D 17/0202 209/9 |
| 2003/0114247 | A1* | 6/2003 | Cavallaro | C08L 81/04 473/357 |
| 2006/0102524 | A1* | 5/2006 | DeFeraudy | B29B 17/02 209/30 |
| 2010/0173116 | A1* | 7/2010 | Bainbridge | B29C 44/3461 428/72 |
| 2014/0183104 | A1* | 7/2014 | Rothman | C02F 1/24 209/168 |
| 2014/0339172 | A1 | 11/2014 | Rothman | |
| 2015/0083646 | A1 | 3/2015 | Didden | |
| 2017/0232451 | A1* | 8/2017 | Rothman | B03D 1/016 209/163 |

* cited by examiner

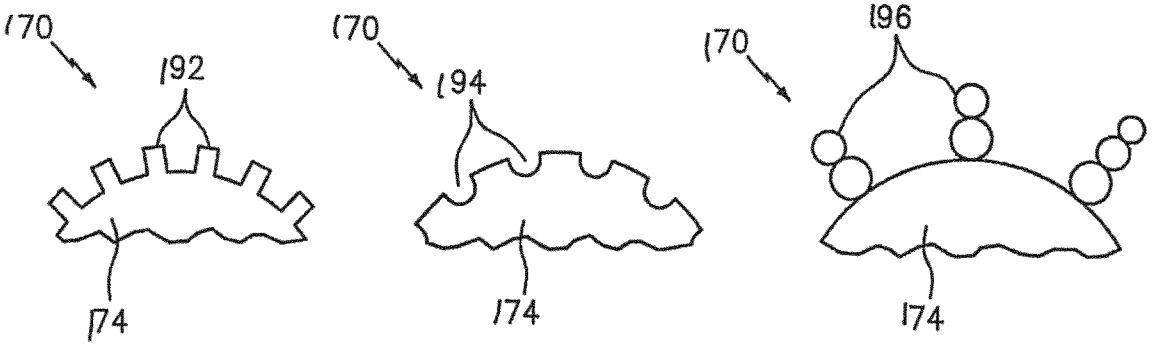
FIG. 9a
FIG. 9b
FIG. 9c
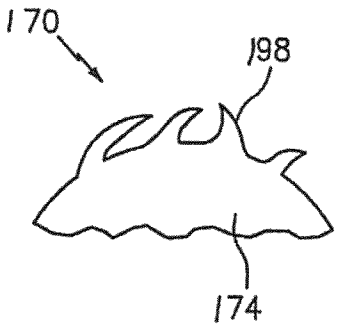
FIG. 9d

TUMBLER CELL FOR MINERAL RECOVERY USING ENGINEERED MEDIA

CROSS-REFERENCE TO RELATED APPLICATIONS

This application claims benefit to provisional application Ser. No. 62/272,026, filed 28 Dec. 2015 entitled "Tumbler Cell Design For Mineral Recovery Using Engineered Media," which is hereby incorporated by reference in its entirety.

This application also claims benefit to provisional patent application Ser. No. 62/276,051, filed 7 Jan. 2016, entitled "Novel recovery media for mineral processing," which is also hereby incorporated by reference in its entirety.

This application also claims benefit to provisional patent application Ser. No. 62/405,569, filed 7 Oct. 2016, entitled "Three dimensional functionalized open-network structure for selective separation of mineral particles in an aqueous system," which is also hereby incorporated by reference in its entirety.

BACKGROUND OF THE INVENTION

1. Technical Field

This invention relates generally to a method and apparatus for separating valuable material from unwanted material in a mixture, such as a pulp slurry, or for processing mineral product for the recovery of minerals in a mineral extraction process.

2. Description of Related Art

In many industrial processes, flotation is used to separate valuable or desired material from unwanted material. By way of example, in this process a mixture of water, valuable material, unwanted material, chemicals and air is placed into a flotation cell. The chemicals are used to make the desired material hydrophobic and the air is used to carry the material to the surface of the flotation cell. When the hydrophobic material and the air bubbles collide they become attached to each other. The bubble rises to the surface carrying the desired material with it.

The performance of the flotation cell is dependent on the bubble surface area flux in the collection zone of the cell. The bubble surface area flux is dependent on the size of the bubbles and the air injection rate. Controlling the bubble surface area flux has traditionally been very difficult. This is a multivariable control problem and there are no dependable real time feedback mechanisms to use for control.

Flotation processing techniques for the separation of materials are a widely utilized technology, particularly in the fields of minerals recovery, industrial waste water treatment, and paper recycling for example.

By way of example, in the case of minerals separation the mineral bearing ore may be crushed and ground to a size, typically around 100 microns, such that a high degree of liberation occurs between the ore minerals and the gangue (waste) material. In the case of copper mineral extraction as an example, the ground ore is then wet, suspended in a slurry, or 'pulp', and mixed with reagents such as xanthates or other reagents, which render the copper sulfide particles hydrophobic.

Froth flotation is a process widely used for separating the valuable minerals from gangue. Flotation works by taking advantage of differences in the hydrophobicity of the mineral-bearing ore particles and the waste gangue. In this process, the pulp slurry of hydrophobic particles and hydrophilic particles is introduced to a water filled tank containing surfactant/frother which is aerated, creating bubbles. The hydrophobic particles attach to the air bubbles, which rise to the surface, forming a froth. The froth is removed and the concentrate is further refined.

The present invention provides a method and apparatus for the recovery of the minerals in a pulp slurry or in the tailings. In particular, the method and apparatus for the recovery of minerals uses engineered recovery media to attract the minerals and to cause the mineral particles to attach to the surfaces of the engineered recovery media. The engineered recovery media are also herein referred to as engineered collection media, mineral collection media, collection media or barren media. The term "engineered media" refers to synthetic bubbles or beads, typically made of a polymeric base material and coated with a hydrophobic material. According to some embodiments, and by way of example, the synthetic bubbles or beads may have a substantially spherical or cubic shape, consistent with that set forth herein, although the scope of the invention is not intended to be limited to any particular type or kind of geometric shape. The term "loaded", when used in conjunction with the collection media, means having mineral particles attached to the surface and the term "unloaded" means having mineral particles stripped from the surface.

SUMMARY OF THE INVENTION

The present invention offers a solution to the above limitations of traditional mineral beneficiation. According to various embodiments of the present invention, minerals in a pulp slurry or in the tailings stream in a mineral extraction process, are recovered by applying engineered recovery media (as disclosed in commonly owned family of cases set forth below, e.g., including PCT application no. PCT/US12/39540, entitled "Mineral separation using Sized-, Weight- or Magnetic-Based Polymer Bubbles or Bead", and PCT application no. PCT/US16/62242, entitled "Utilizing Engineered Media for Recovery of Minerals in Tailings Stream at the End of a Flotation Separation Process") in accordance with the present invention. The process and technology of the present invention circumvents the performance limiting aspects of the standard flotation process and extends overall recovery. The engineered recovery media (also referred to as engineered collection media, collection media or barren media) obtains higher recovery performance by allowing independent optimization of key recovery attributes which is not possible with the standard air bubble in conventional flotation separation.

The present invention provides a method and an apparatus for the recovery of the minerals in the pulp slurry and the minerals present in the tailings using engineered collection media that can be designed with varying specific gravities. This freedom allows new processing cell design wherein the collection media do not necessarily reach the top of the cell to form a froth layer. Instead, with various embodiments of the cell, the collection media can be introduced into and removed from the top, side or bottom of the cell. According some embodiments of the present invention, the cell may be configured for rotation along a rotation axis while allowing the introduction of the collection media on one end of the cell and removal of the loaded media on the other end. The loaded media are also referred herein as mineral laden media or collection media with minerals captured on the media surface. The processing cell is also referred to as a tumbler cell.

According to an embodiment of the present invention, the tumbler cell may take the form of a horizontal pipe, cylinder or drum with two ends. The tumbler cell can be configured as a co-current design in which the slurry and the engineered collection media are introduced into the cell on one end, and the mixture containing the loaded media and slurry exits the tumbling cell on the other end. With this configuration, the loaded media and the slurry exit the tumbling cell together and they are separated afterward. The tumbler cell can also be configured as a counter-current horizontal design in which the slurry and the engineered collection are introduced into the cell from the opposing ends of the cell. The tumbler cell may include an internal screen, trommel, magnetic separation system, or other physical separation process located with the rotating drum. With this alternative configuration, the loaded media and the slurry are separately discharged from the tumbler cell.

With the tumbler cell configurable as a co-current design or a counter-current design, kinetics can be controlled by the rotation of the cell so as to optimize the recovery for specific mineral properties such as size and/or liberation. Residence time of the collection media and slurry can be controlled by inclination and/or orifice plates or weirs placed within the cell, and by the length, diameter or rotation speed of the horizontal pipe or drum. Both the collection media and slurry can be advanced through the cell with the assistance of vanes, baffles, lifters or other mechanisms. With the tumbler cell, higher percentage volume fractions of collection media can be used as compared to conventional flotation cells. As such, the tumbler cell yields higher mineral recovery.

According to an embodiment of the present invention, the tumbler cell can be divided into multiple chambers to create a staged recovery reactor in which a variety of media types, kinetics, etc. may the employed. Each stage can be optimized to address different particle sizes, particle liberation classes, etc. The charge kinematics and, therefore, the particle collection kinetics can be controlled using a variety of lifters, mixers, agitators, re-circulators, etc. that are specific for each chamber. The media shape, specific gravity, and size can also be used to control the kinematics or velocity profile of the media within the tumbler. This allows for improved selectivity depending on the particle size or weight, and how these properties determine the particle movement for any given chamber design.

The Apparatus

Thus, the first aspect of the present invention may take the form of an apparatus, featuring:

a container configured to hold a mixture comprising engineered collection media and a slurry containing mineral particles; and a movement mechanism configured to turn the container such that at least part of the mixture in an upper part of the container is caused to interact with at least part of the mixture in a lower part of container so as to enhance a contact between the engineered collection media and the mineral particles in the slurry, wherein the engineered collection media comprise collection surfaces functionalized with a chemical having molecules to attract the mineral particles to the collection surfaces so as to form mineral laden media in the mixture in said contact.

According to an embodiment of the present invention, the movement mechanism may be configured to rotate the container along a horizontal axis.

According to an embodiment of the present invention, the container may include a first input configured to receive the engineered collection media and a second input configured to receive the slurry.

According to an embodiment of the present invention, the container also may include an output for discharging at least part of the mixture from the container, and wherein the mixture discharged from the container may include the mineral laden media and ore residue.

According to an embodiment of the present invention, the container may include a first side and a second side, wherein the first input and the second input are arranged on the first side and the output is arranged on the second side.

According to an embodiment of the present invention, the mixture in the container may include the mineral laden media and ore residue, the container may also feature a first output, a second output and a separating device configured to separate the mineral laden media from the ore residue, the first output configured to discharge the mineral laden media, the second output configured to discharge the ore residue from the container.

According to an embodiment of the present invention, the container may include a first side and a second side, and wherein the first input and the second output may be arranged on the first side and the second input and the first output are arranged on the second side.

According to an embodiment of the present invention, the engineered collection media may include synthetic bubbles or beads, and the chemical may be selected from the group consisting of polysiloxanes, poly(dimethylsiloxane), hydrophobically-modified ethyl hydroxyethyl cellulose, polysiloxanates, alkylsilane and fluoroalkylsilane and what are commonly known as pressure sensitive adhesives with low surface energy.

According to an embodiment of the present invention, the synthetic bubbles or beads may be made of an open-cell foam.

According to an embodiment of the present invention, the synthetic bubbles or beads may have a substantially spherical shape.

According to an embodiment of the present invention, the synthetic bubbles or beads may have a substantially cubic shape.

The Method

The second aspect of the present invention may take the form of a method, featuring steps for:

providing a container configured to hold a mixture comprising engineered collection media and a slurry containing mineral particles; and causing the container to turn such that at least part of the mixture in an upper part of the container is caused to interact with at least part of the mixture in a lower part of the container so as to enhance a contact between the engineered collection media and the mineral particles in the slurry, wherein the engineered collection media include collection surfaces functionalized with a chemical having molecules to attract the mineral particles to the collection surfaces so as to form mineral laden media in the mixture in said contact.

According to an embodiment of the present invention, the movement mechanism may be configured to rotate the container along a horizontal axis.

According to an embodiment of the present invention, the engineered collection media may include synthetic bubbles or beads consistent with that set forth herein, and the chemical may be selected from the group consistent with that set forth herein.

The System

The third aspect of the present invention may take the form of a system, featuring:

a container configured to hold a mixture comprising engineered collection media and a slurry containing mineral particles;

a movement mechanism configured to turn the container such that at least part of the mixture in an upper part of the container is caused to interact with at least part of the mixture in a lower part of container so as to enhance a contact between the engineered collection media and the mineral particles in the slurry, wherein the engineered collection media comprise collection surfaces functionalized with a chemical having molecules to attract the mineral particles to the collection surfaces so as to form mineral laden media in the mixture in said contact, and wherein the container further configured to discharge at least part of the mixture from the container, the mixture discharged from the container including the mineral laden media; and a stripping device configured to receive the mineral laden media and to separate the mineral particles attached on the collection surfaces from the engineered collection media.

According to an embodiment of the present invention, the container may include an input arranged to receive the engineered collection media, the system may also include a re-circulation device configured to return the engineered collection media from the stripping device to the input of the container.

According to an embodiment of the present invention, the mixture discharged from the container may also include ore residue, and the system may also include a separation device configured to separate the mineral laden media and the ore residue, and to provide the mineral laden media to the stripping device.

A Staged Recovery Reactor

According to some embodiments, the container may include, or take the form of, a tumbler cell divided into multiple chambers to create a staged recovery reactor.

The multiple chambers may be employed with a variety of media types and kinetics to create the staged recovery reactor.

Each of the multiple chambers may be configured with a respective media type and a respective kinetics to create a respective stage in the staged recovery reactor.

The multiple chambers may be configured to address or process different particle sizes or particle liberation classes in the staged recovery reactor.

The kinetics may include charge kinematics configured to control particle collection kinetics, including by using a variety of lifters, mixers, agitators or re-circulators that are specific for each chamber in the staged recovery reactor.

The media shape, specific gravity, and size may be used to control the kinematics or velocity profile of the engineered collection media within the tumbler.

The variety of media types may include an open cell foam having a specific surface area.

The Open Cell Foam

The engineered collection media may include an open cell foam having a surface with a surface area.

The open cell foam may be made from a material or materials selected from a group that includes polyester urethanes, reinforced urethanes, composites like PVC coated PU, non-urethanes, as well as metal, ceramic, and carbon fiber foams and hard, porous plastics, in order to enhance mechanical durability.

The open cell foam may be coated with polyvinylchloride, and then coated with a compliant, tacky polymer of low surface energy in order to enhance chemical durability.

The open cell foam may be primed with a high energy primer prior to application of a functionalized polymer coating to increase the adhesion of the functionalized polymer coating to the surface of the open cell foam.

The surface of the open cell foam may be chemically or mechanically abraded to provide "grip points" on the surface for retention of the functionalized polymer coating.

The surface of the open cell foam may be coated with a functionalized polymer coating that covalently bonds to the surface to enhance the adhesion between the functionalized polymer coating and the surface.

The surface of the open cell foam may be coated with a functionalized polymer coating in the form of a compliant, tacky polymer of low surface energy and a thickness selected for capturing certain mineral particles and collecting certain particle sizes, including where thin coatings are selected for collecting proportionally smaller particle size fractions and thick coatings are selected for collecting additional large particle size fractions.

The surface area may be configured with a specific number of pores per inch that is determined to target a specific size range of mineral particles in the slurry.

The engineered collection media may include different open cell foams having different specific surface areas that are blended to recover a specific size distribution of mineral particles in the slurry.

BRIEF DESCRIPTION OF THE DRAWING

FIGS. 9*a*-9*d* illustrate various surface features on an engineered bead to increase the collection area.

DETAILED DESCRIPTION OF THE INVENTION

FIGS. 1, 2*a*, 2*b*, 3 and 4

Figure 1:
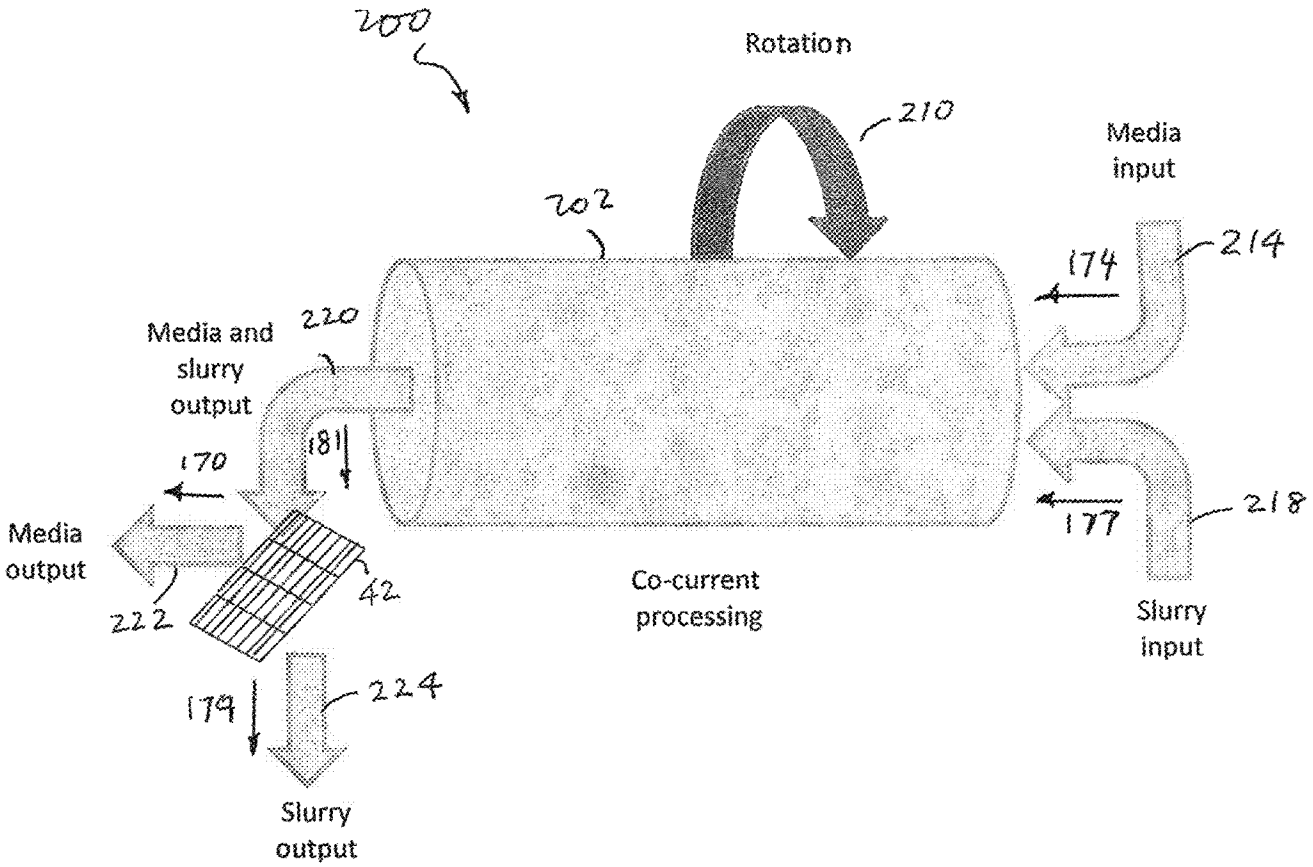
FIG. 1 illustrates a tumbler cell configured for co-current processing, according to an embodiment of the present invention.

As seen in FIG. 1, the tumbler cell 200 has a container 202 configured to hold a mixture comprising engineered collection media 174 and a pulp slurry or slurry 177. The slurry 177 contains mineral particles (see FIGS. 7*a* and 7*b*). The container 202 has a first input 214 configured to receive the engineered collection media 174 and a second input 218 configured to receive the slurry 177. On the other side of the container 202, an output 220 is provided for discharging at least part of the mixture 181 from the container 202 after the engineered collection media 174 are caused to interact with the mineral particles in slurry 177 in the container. The mixture 181 contains mineral laden media or loaded media 170 (see FIG. 7*a*) and ore residue or tailings 179. The arrangement of the inputs and output on the container 202 as shown in FIG. 1 is known as a co-current configuration. The engineered collection media 174 have collection surfaces functionalized with a chemical having molecules to attract the mineral particles to the collection surface so as to form mineral laden media (see FIG. 7*a*). In general, if the specific gravity of the engineered collection media 174 is smaller than the slurry 177, a substantial amount of the engineered collection media 174 in the container 202 may stay afloat on top the slurry 177. If the specific gravity of the collection media 174 is greater than the slurry 177, a substantial amount of the engineered collection media 174 may sink to the bottom of the container 202. As such, the interaction between the engineered collection media 174 and the mineral particles in slurry 177 may not be efficient to form mineral laden media 170. In order to increase or enhance the contact between the engineered collection media 174 and the mineral particles in slurry 177, the container 202 is caused to turn such that at least some of the mixture in the upper part of the container is caused to interact with at least some of mixture in the lower part of the container 202 (see FIG. 2*b*). After being discharged from the container 202, the mixture 181 comprising mineral laden media 170 and ore residue 179 is processed through a separation device such as a screen 42 so that the mineral laden media 170 and the ore residue 179 can be separated. The mineral laden media 170 are directed by a path or outlet 222 so that the mineral laden media 170 can be collected. The ore residue 179 is directed by a path or outlet 224 to be thickened, for example. It should be noted that the mixture 181 discharged through output 220 also contains mineral particles that are not attached to the engineered collection media 174 to form mineral laden media 170, water and other ore particles in slurry 177, and some unloaded engineered collection media, or barren media 174. After being separated by screen 42, the mineral laden media 170, along with the unloaded engineered collection media 174, are directed to the media output or path 222, while the unattached mineral particles, water and other ore particles in slurry 177 are directed to the slurry output 224 to be treated as tailings or ore residue 179.

The container 202 can be a horizontal pipe or cylindrical drum configured to be rotated, as indicated by numeral 210, along a horizontal axis, for example.

Figure 2A:
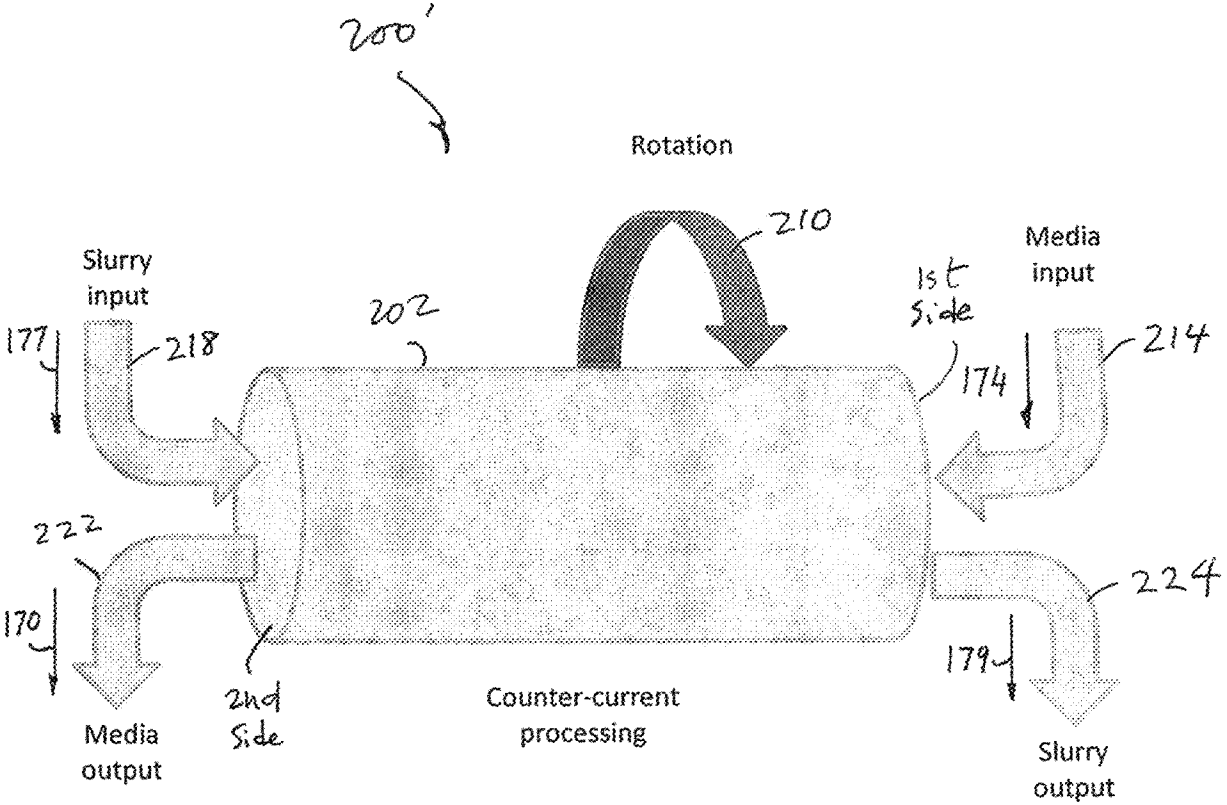
FIG. 2*a* illustrates a tumbler cell configured for counter-current processing, according to an embodiment of the present invention.
Figure 2B:
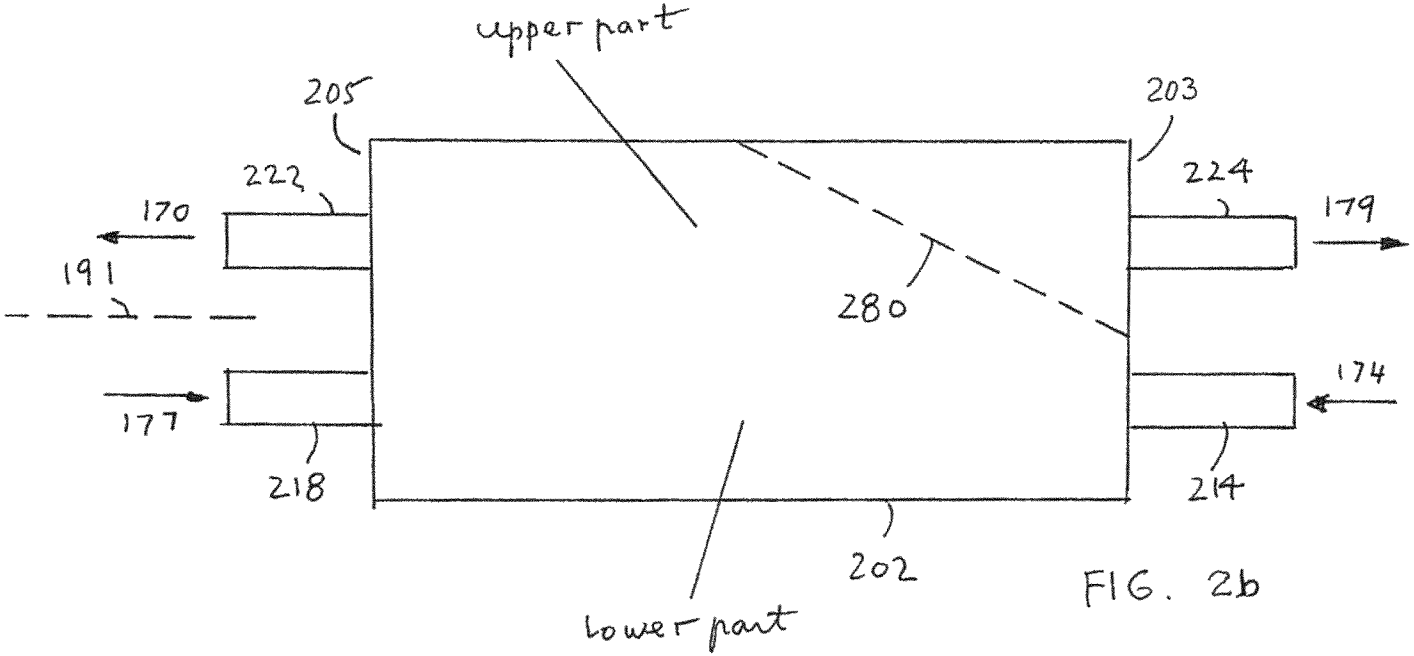
FIG. 2*b* illustrates a tumbler cell configured for counter-current processing in which internal screening is used to separate the loaded media and the slurry before they are discharged.

As seen in FIGS. 2*a* and 2*b*, the container 202 of the tumbler cell 200' has a first side 203 and a second side 205 to provide a first input 214, a second input 218, a first output 222 and a second output 224. On the first side 203, the first input 214 is arranged to receive engineered collection media 174 and the second output 224 is arranged to discharge ore residue 179. On the second side 205, the second input 218 is arranged to receive slurry 177 and the first output 222 is arranged to discharge mineral laden media 170. The arrangement of the inputs and outputs on the container 202 is known as a counter-current configuration. In the counter-current configuration, an internal separation device such as a screen 280 is used to prevent the medium laden media 170 and the engineered collection media 174 in the container 202 from being discharged through the second output 224. As such, what is discharged through the second output 224 is ore residue or tailings 179. By rotating the container 202 along the rotation axis 191, at least some of the mixture in an upper part of the container 202 is caused to interact with at least some of the mixture in a lower part of the container 202 so as to increase or enhance the contact between the engineered collection media 174 and the mineral particles in slurry 177.

Figure 3:
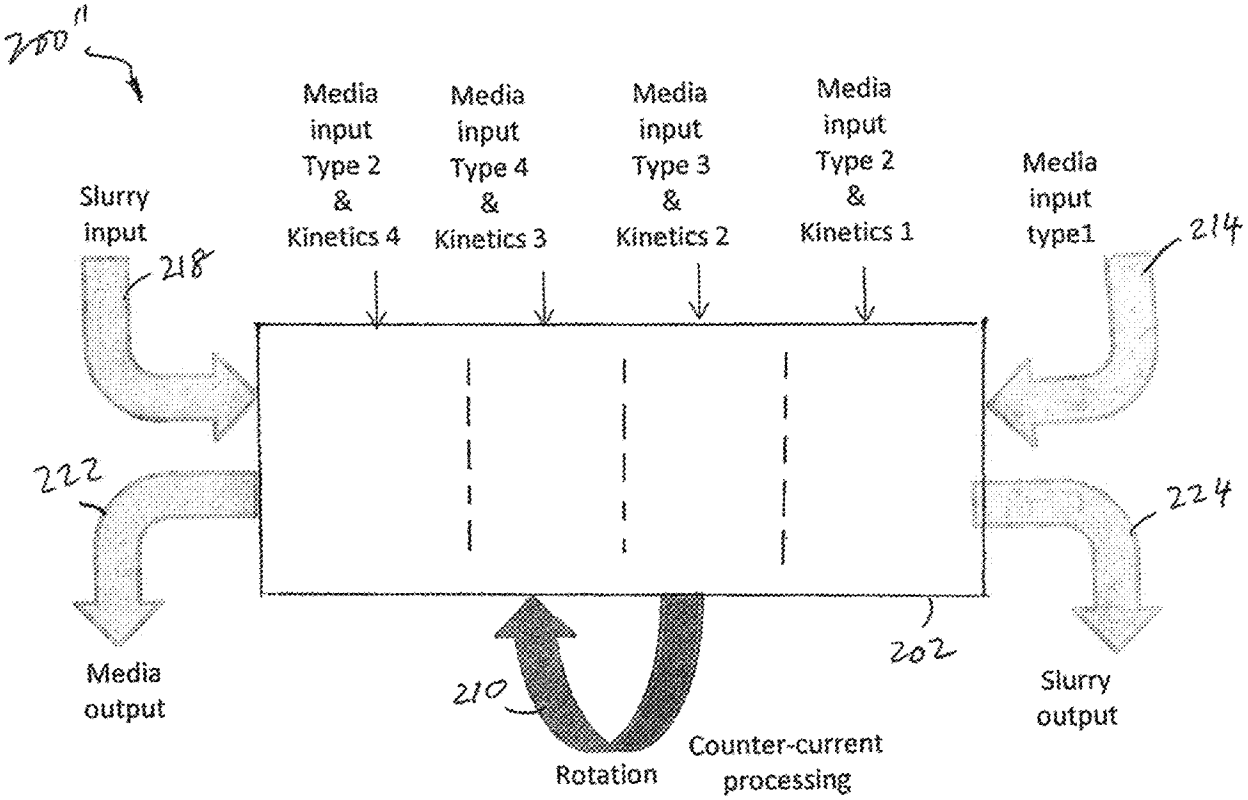
FIG. 3 illustrates a tumbler cell with multiple chambers, according to an embodiment of the present invention.

FIG. 3 illustrates a tumbler cell 200" in which the container 202 are divided into a plurality of chambers to create a staged recovery reactor. With the multiple cell configuration, a variety of collection media, kinetics, etc. may be employed. Optionally, each stage can be optimized to address different particle sizes, particle liberation classes, etc. The charge kinematics and, therefore, the particle collection kinetics can be modified or arranged using a variety of filters, mixers, agitators, re-circulators, etc. that are specific for each chamber. The shape, specific gravity and size of the engineered collection media can also be used to control the kinematics or velocity profile of the collection media within the tumbler cell. This allows for improved selectivity in relationship to the particle size or weight and how these properties determine the particle movement for a given chamber design.

According to various embodiments of the present invention, the surfaces of the engineered collection media 174 are functionalized with a chemical having molecules so as to attract or attach the mineral particles in the slurry to the surfaces of the engineered collection media 174. The engineered collection media comprise synthetic bubbles or beads, and the chemical is selected from the group consisting of polysiloxanes, poly(dimethylsiloxane), hydrophobically-modified ethyl hydroxyethyl cellulose, polysiloxanates, alkylsilane and fluoroalkylsilane, and what are commonly known as pressure sensitive adhesives with low surface energy, for example.

Figure 4:
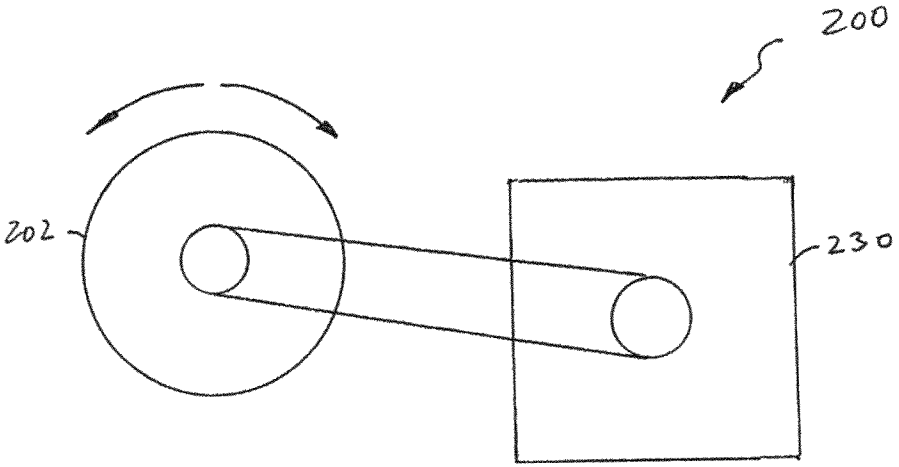
FIG. 4 illustrates a rotation scheme, according to an embodiment of the present invention.

As illustrated in FIG. 4, the tumbler cell 200 (or 200', 200") is caused to rotate by a movement mechanism 230 either in a clockwise direction or a counter-clockwise direction in a continuous fashion or in an intermittent fashion. The rotation can be in one direction or two directions alternately. The movement mechanism 230 can be an electric motor with a linking belt or driving gears or any suitable movement device.

Figure 5:
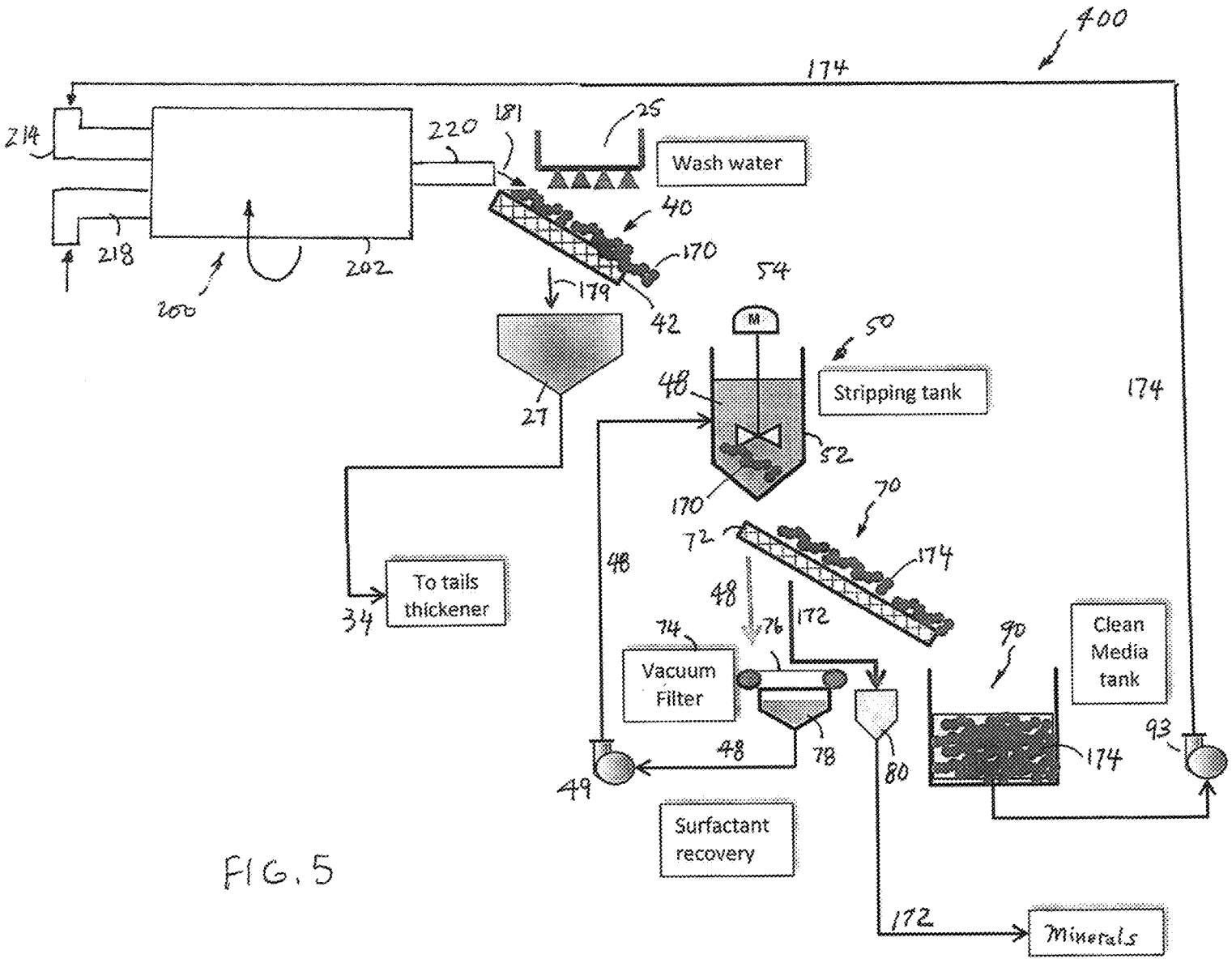
FIG. 5 shows a system for mineral recovery in association with a tumbler cell configured for co-current processing.
Figure 6:
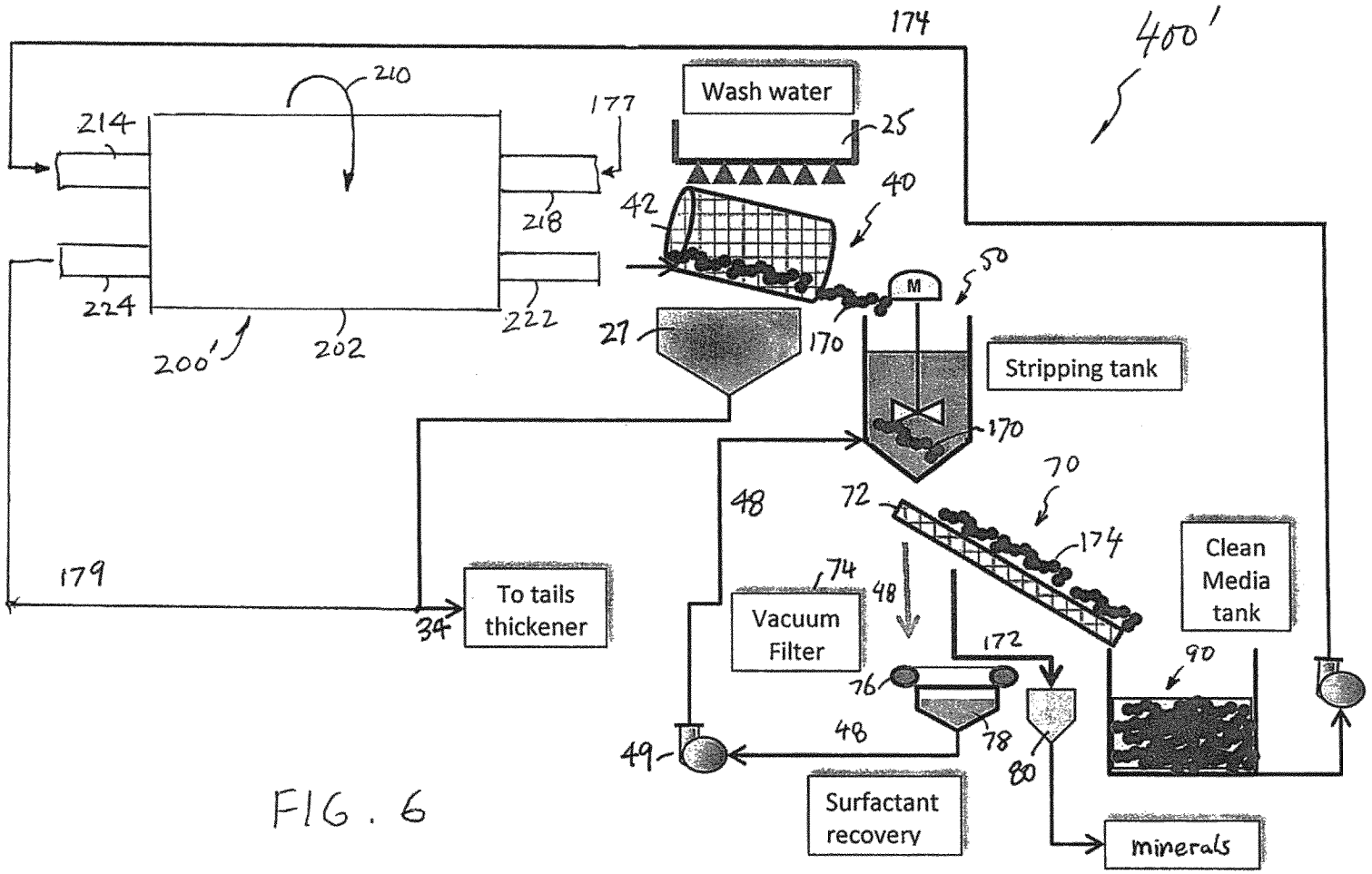
FIG. 6 shows a system for mineral recovery in association with a tumbler cell configured for counter-current processing.

FIGS. 5 and 6

The different embodiments of the tumbler cell 200 (200', 200") of the present invention can be integrated into a system 400 or 400' wherein various devices are used to process the mineral laden media 170. For example, the mineral laden media 170 can be washed and stripped in order to detach the mineral particles 172 from the surfaces of the engineered collection media 174 and to re-circulate the engineered collection media 174 to the tumbler cell 200 or 200'.

As seen in FIG. 5, the discharged mixture 181 from the output 220 of tumbler cell 200 is directed to a first separation stage 40. The mixture 181 mainly contains mineral laden media 170 and ore residue 179. The first separation stage 40 has a first screen 42 to move the mineral laden media 170 while wash water 25 sprays on the mineral laden media 170 to rid of the ore residue 179. The ore residue 179, together with the wash water, is collected in a container 27 and directed to a tails thickener tank 34. The mineral laden media 170 are then mixed with a stripping agent 48, such as a surfactant system, in a stripping device or tank 50. A stirrer 54 is used to agitate the mineral laden media 170 so as to detach the mineral particles 172 from the engineered collection media 174. At a second separation stage 70, a second screen 72 is used to separate the engineered collection media 174 from the stripping agent 48 and the mineral particles 172. The engineered collection media 174 are conveyed to a cleaning tank 90 for cleaning, whereas the stripping agent 48 and the mineral particles 172 that pass through the screen 72 are provided to a separator, such as a vacuum filter 74, for separation. The vacuum filter 74 has a conveyor belt 76 made of a mesh material, for example, to deliver the mineral particles 172 to a collection container 80, while a suction force is used to cause the stripping agent 48 to fall into a collection container 78. A hydraulic pump 49 or the like is used to recirculate the stripping agent to the stripping tank 50 for reuse. The engineered collection media 174 from the second separation stage 70 are cleaned in a cleaning tank 90 using water or other cleaning solution. After the cleaning stage, a hydraulic pump 93 or the like recirculates engineered collection media 174 to the tumbler cell 200 for reloading. With the tumbler cell 200, the engineered collection media 174 may have a specific gravity smaller than, equal to, or greater than the slurry 177 in the container 202.

When a tumbler cell 200' with a counter-current configuration as shown in FIGS. 2A and 2B is used to discharge the mineral laden media 170 through the output 222, the mineral laden media 170 can be directly conveyed to the stripping tank 50 for stripping. Alternatively, the mineral laden media 170 can be processed to rid of the ore residue remaining on the mineral laden media 170 as shown in FIG. 6. As with the process as shown in FIG. 5, the mineral laden media 170 is moved along the screen 42 in the first separation stage 40 while wash water 25 sprays on the mineral laden media 170 to rid of the ore residue 179. The ore residue 179, together with the wash water, is collected in a container 27 and conveyed to a tails thickener tank 34. From the tumbler cell 200', the ore residue or tailings 179 is also conveyed to the tails thickener tank 34. The mineral laden media 170 are then stripped in order to detach the mineral particles from the engineered collection media 174. The engineered collection media 174 can be returned to the container 202 through input 214 for reuse. Again, with tumbler cell 200', the engineered collection media 174 may have a specific gravity smaller than, equal to, or greater than the slurry 177 in the container 202.

FIGS. 7*a*, 7*b*, 8*a*-8*e*, 9*a*-9*d* and 10

Figure 7B:
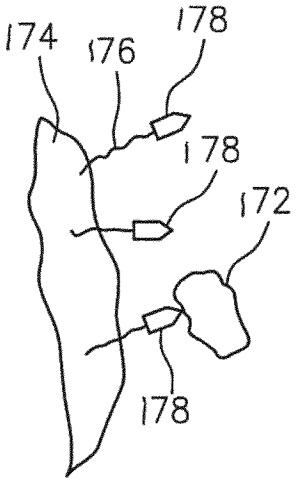
FIG. 7*b* illustrates part of a loaded bead having molecules to attract mineral particles.
Figure 7A:
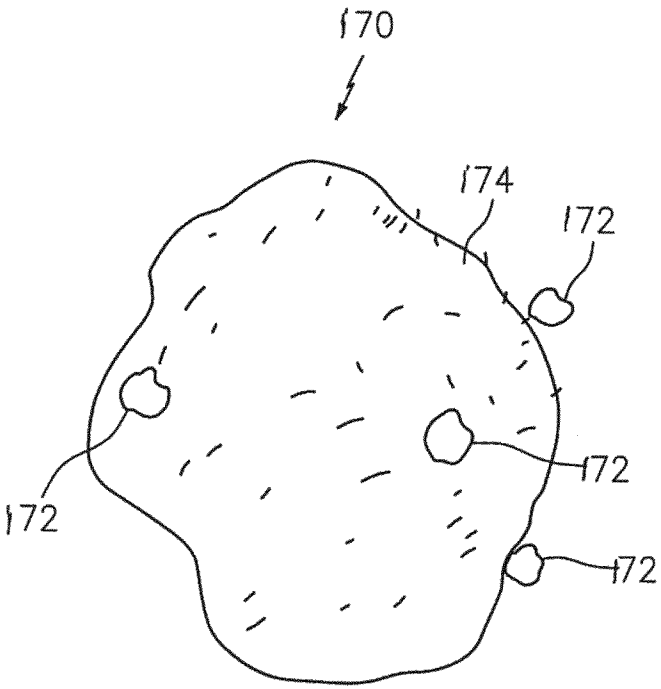
FIG. 7*a* illustrates a mineral laden synthetic bead, or loaded bead.

FIG. 7*a* illustrates a mineral laden synthetic bead, or loaded bead 170. As illustrated, a synthetic bead 174 can attract many mineral particles 172. FIG. 7*b* illustrates part of a loaded bead having molecules (176, 178) to attract mineral particles.

As shown in FIGS. 7*a* and 7*b*, the synthetic bead 170 has a bead body to provide a bead surface 174. At least the outside part of the bead body is made of a synthetic material, such as polymer, so as to provide a plurality of molecules or molecular segments 176 on the surface 174. The molecule 176 is used to attach a chemical functional group 178 to the surface 174. In general, the molecule 176 can be a hydrocarbon chain, for example, and the functional group 178 can have an anionic bond for attracting or attaching a mineral, such as copper to the surface 174. A xanthate, for example, has both the functional group 178 and the molecular segment 176 to be incorporated into the polymer that is used to make the synthetic bead 170. A functional group 178 is also known as a collector that is either ionic or non-ionic. The ion can be anionic or cationic. An anion includes oxyhydryl, such as carboxylic, sulfates and sulfonates, and sulfhydral, such as xanthates and dithiophosphates. Other molecules or compounds that can be used to provide the function group 178 include, but are not limited to, thionocarboamates, thioureas, xanthogens, monothiophosphates, hydroquinones and polyamines. Similarly, a chelating agent can be incorporated into or onto the polymer as a collector site for attracting a mineral, such. As shown in FIG. 7*b*, a mineral particle 172 is attached to the functional group 178 on a molecule 176. In general, the mineral particle 172 is much smaller than the synthetic bead 170. Many mineral particles 172 can be attracted to or attached to the surface 174 of a synthetic bead 170.

Figure 8A:
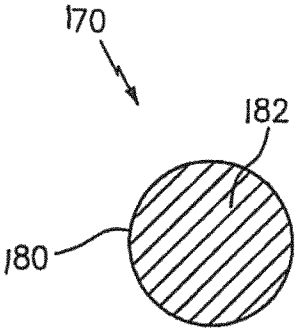
FIGS. 8*a*-8*e* illustrate an engineered bead with different shapes and structures.
Figure 8B:
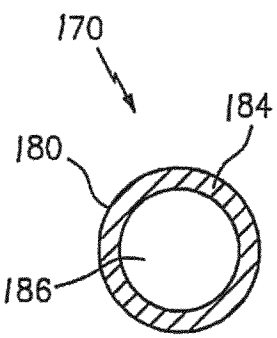
Figure 8C:
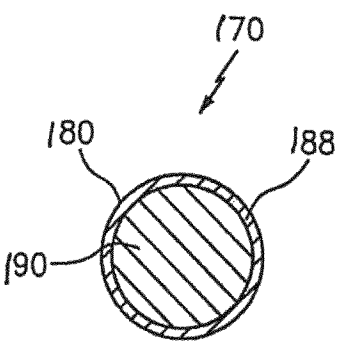

In some embodiments of the present invention, a synthetic bead has a solid-phase body made of a synthetic material, such as polymer. The polymer can be rigid or elastomeric. An elastomeric polymer can be polyisoprene or polybutadiene, for example. The synthetic bead 170 has a bead body 180 having a surface comprising a plurality of molecules with one or more functional groups for attracting mineral particles to the surface. A polymer having a functional group to collect mineral particles is referred to as a functionalized polymer. In one embodiment, the entire interior part 182 of the synthetic bead 180 is made of the same functionalized material, as shown in FIG. 8*a*. In another embodiment, the bead body 180 comprises a shell 184. The shell 184 can be formed by way of expansion, such as thermal expansion or pressure reduction. The shell 184 can be a micro-bubble or a balloon. In FIG. 8*b*, the shell 184, which is made of functionalized material, has an interior part 186. The interior part 186 can be filled with air or gas to aid buoyancy, for example. The interior part 186 can be used to contain a liquid to be released during the mineral separation process. The encapsulated liquid can be a polar liquid or a non-polar liquid, for example. The encapsulated liquid can contain a depressant composition for the enhanced separation of copper, nickel, zinc, lead in sulfide ores in the flotation stage, for example. The shell 184 can be used to encapsulate a powder which can have a magnetic property so as to cause the synthetic bead to be magnetic, for example. The encapsulated liquid or powder may contain monomers, oligomers or short polymer segments for wetting the surface of mineral particles when released from the beads. For example, each of the monomers or oligomers may contain one functional group for attaching to a mineral particle and an ion for attaching the wetted mineral particle to the synthetic bead. The shell 84 can be used to encapsulate a solid core, such as Styrofoam to aid buoyancy, for example. In yet another embodiment, only the coating of the bead body is made of functionalized polymer. As shown in FIG. 8*c*, the synthetic bead has a core 190 made of ceramic, glass or metal and only the surface of core 190 has a coating 88 made of functionalized polymer. The core 190 can be a hollow core or a filled core depending on the application. The core 190 can be a micro-bubble, a sphere or balloon. For example, a filled core made of metal makes the density of the synthetic bead to be higher than the density of the pulp slurry, for example. The core 190 can be made of a magnetic material so that the para-, ferri-, ferro-magnetism of the synthetic bead is greater than the para-, ferri-, ferro-magnetism of the unwanted ground ore particle in the mixture. In a different embodiment, the synthetic bead can be configured with a ferro-magnetic or ferri-magnetic core that attract to paramagnetic surfaces. A core 90 made of glass or ceramic can be used to make the density of the synthetic bead substantially equal to the density of the pulp slurry so that when the synthetic beads are mixed into the pulp slurry for mineral collection, the beads can be in a suspension state.

Figure 8D:
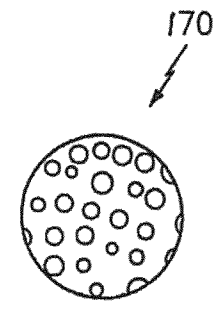
Figure 8E:
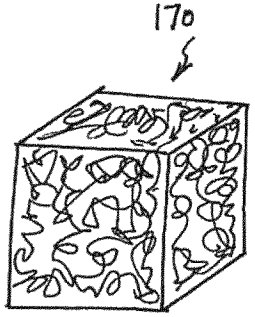

According to a different embodiment of the present invention, the synthetic bead 170 can be a porous block or take the form of a sponge or foam with multiple segregated gas filled chambers as shown in FIGS. 8*d* and 8*e*.

It should be understood that the term "bead" does not limit the shape of the synthetic bead of the present invention to be spherical, as shown in FIGS. 8*a*-8*d*. In some embodiments of the present invention, the synthetic bead 170 can have an elliptical shape, a cylindrical shape, a shape of a block. Furthermore, the synthetic bead can have an irregular shape.

It should also be understood that the surface of a synthetic bead, according to the present invention, is not limited to an overall smooth surface as shown in FIGS. 8*a*-8*d*. In some embodiments of the present invention, the surface can be irregular and rough. For example, the surface 174 can have some physical structures 192 like grooves or rods as shown in FIG. 9*a*. The surface 174 can have some physical structures 194 like holes or dents as shown in FIG. 9*b*. The surface 174 can have some physical structures 196 formed from stacked beads as shown in FIG. 9*c*. The surface 174 can have some hair-like physical structures 198 as shown in FIG. 9*d*. In addition to the functional groups on the synthetic beads that attract mineral particles to the bead surface, the physical structures can help trapping the mineral particles on the bead surface. The surface 174 can be configured to be a honeycomb surface or sponge-like surface for trapping the mineral particles and/or increasing the contacting surface.

It should also be noted that the synthetic beads of the present invention can be realized by a different way to achieve the same goal. Namely, it is possible to use a different means to attract the mineral particles to the surface of the synthetic beads. For example, the surface of the polymer beads, shells can be functionalized with a hydrophobic chemical molecule or compound. The synthetic beads and/or engineered collection media can be made of a polymer. The term "polymer" in this specification means a large molecule made of many units of the same or similar structure linked together. Furthermore, the polymer can be naturally hydrophobic or functionalized to be hydrophobic. Some polymers having a long hydrocarbon chain or silicon-oxygen backbone, for example, tend to be hydrophobic. Hydrophobic polymers include polystyrene, poly(d,l-lactide), poly(dimethylsiloxane), polypropylene, polyacrylic, polyethylene, etc. The bubbles or beads, such as synthetic bead 170 can be made of glass to be coated with hydrophobic silicone polymer including polysiloxanates so that the bubbles or beads become hydrophobic. The bubbles or beads can be made of metal to be coated with silicone alkyd copolymer, for example, so as to render the bubbles or beads hydrophobic. The bubbles or beads can be made of ceramic to be coated with fluoroalkylsilane, for example, so as to render the bubbles and beads hydrophobic. The bubbles or beads can be made of hydrophobic polymers, such as polystyrene and polypropylene to provide a hydrophobic surface. The wetted mineral particles attached to the hydrophobic synthetic bubble or beads can be released thermally, ultrasonically, electromagnetically, mechanically or in a low pH environment.

The multiplicity of hollow objects, bodies, elements or structures may include hollow cylinders or spheres, as well as capillary tubes, or some combination thereof. The scope of the invention is not intended to be limited to the type, kind or geometric shape of the hollow object, body, element or structure or the uniformity of the mixture of the same.

Figure 10:
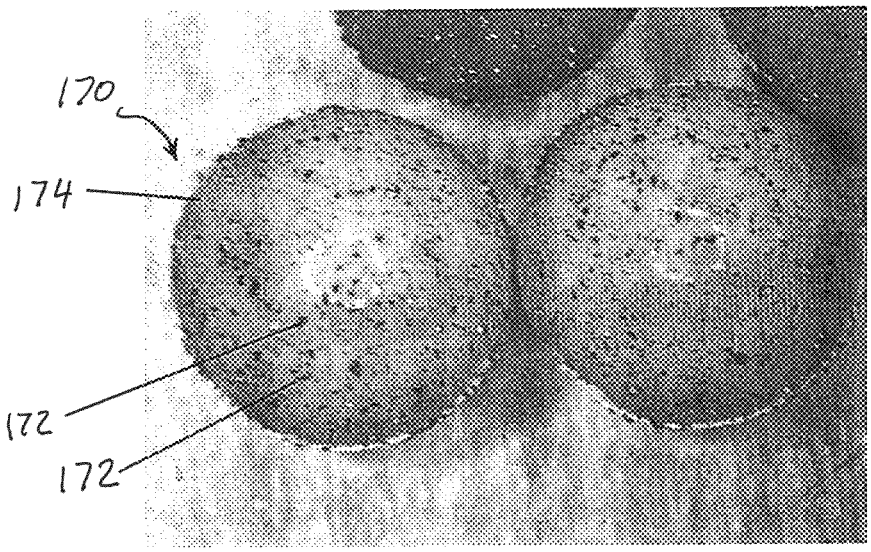
FIG. 10 shows a picture of mineral laden media.

FIG. 10 shows a picture of some mineral laden media 170 having a plurality of mineral particles 172 attached to the surface of engineered collection media 174. Here the engineered collection media 174 take the form of synthetic beads of a spherical shape.

Three Dimensional Functionalized Open-Network Structure for Selective Separation of Mineral Particles in an Aqueous System In general, the mineral processing industry has used flotation as a means of recovering valuable minerals. This process uses small air bubbles injected into a cell containing the mineral and slurry whereby the mineral attaches to the bubble and is floated to the surface. This process leads to separating the desired mineral from the gangue material. Alternatives to air bubbles have been proposed where small spheres with proprietary polymer coatings are instead used. This disclosure proposes a new and novel media type with a number of advantages.

One disadvantage of spherical shaped recovery media such as a bubble, is that it possesses a poor surface area to volume ratio. Surface area is an important property in the mineral recovery process because it defines the amount of mass that can be captured and recovered. High surface area to volume ratios allows higher recovery per unit volume of media added to a cell. As illustrated in FIG. 8*e*, open-cell foam and sponge-like material can be as engineered collection media. Open cell or reticulated foam offers an advantage over other media shapes such as the sphere by having higher surface area to volume ration. Applying a functionalized polymer coating that promotes attachment of mineral to the foam "network" enables higher recovery rates and improved recovery of less liberated mineral when compared to the conventional process. For example, open cells allow passage of fluid and particles smaller than the cell size but capture mineral bearing particles the come in contact with the functionalized polymer coating. Selection of cell size is dependent upon slurry properties and application.

The coated foam may be cut in a variety of shapes and forms. For example, a polymer coated foam belt can be moved through the slurry to collect the desired minerals and then cleaned to remove the collected desired minerals. The cleaned foam belt can be reintroduced into the slurry. Strips, blocks, and/or sheets of coated foam of varying size can also be used where they are randomly mixed along with the slurry in a mixing cell. The thickness and cell size of a foam can be dimensioned to be used as a cartridge-like filter which can be removed, cleaned of recovered mineral, and reused.

As mentioned earlier, the open cell or reticulated foam, when coated or soaked with hydrophobic chemical, offers an advantage over other media shapes such as sphere by having higher surface area to volume ratio. Surface area is an important property in the mineral recovery process because it defines the amount of mass that can be captured and recovered. High surface area to volume ratios allows higher recovery per unit volume of media added to a cell.

The open cell or reticulated foam provides functionalized three dimensional open network structures having high surface area with extensive interior surfaces and tortuous paths protected from abrasion and premature release of attached mineral particles. This provides for enhanced collection and increased functional durability. Spherical shaped recovery media, such as beads, and also of belts, and filters, is poor surface area to volume ratio—these media do not provide high surface area for maximum collection of mineral. Furthermore, certain media such as beads, belts and filters may be subject to rapid degradation of functionality.

Applying a functionalized polymer coating that promotes attachment of mineral to the foam "network" enables higher recovery rates and improved recovery of less liberated mineral when compared to the conventional process. This foam is open cell so it allows passage of fluid and particles smaller than the cell size but captures mineral bearing particles the come in contact with the functionalized polymer coating. Selection of cell size is dependent upon slurry properties and application.

A three-dimensional open cellular structure optimized to provide a compliant, tacky surface of low energy enhances collection of hydrophobic or hydrophobized mineral particles ranging widely in particle size. This structure may be comprised of open-cell foam coated with a compliant, tacky polymer of low surface energy. The foam may be comprised of reticulated polyurethane or another appropriate open-cell foam material such as silicone, polychloroprene, polyisocyanurate, polystyrene, polyolefin, polyvinylchloride, epoxy, latex, fluoropolymer, phenolic, EPDM, nitrile, composite foams and such. The coating may be a polysiloxane derivative such as polydimethylsiloxane and may be modified with tackifiers, plasticizers, crosslinking agents, chain transfer agents, chain extenders, adhesion promoters, aryl or alky copolymers, fluorinated copolymers, hydrophobizing agents such as hexamethyldisilazane, and/or inorganic particles such as silica or hydrophobic silica. Alternatively, the coating may be comprised of materials typically known as pressure sensitive adhesives, e.g. acrylics, butyl rubber, ethylene vinyl acetate, natural rubber, nitriles; styrene block copolymers with ethylene, propylene, and isoprene; polyurethanes, and polyvinyl ethers as long as they are formulated to be compliant and tacky with low surface energy.

The three-dimensional open cellular structure may be coated with a primer or other adhesion agent to promote adhesion of the outer collection coating to the underlying structure.

In addition to soft polymeric foams, other three-dimensional open cellular structures such as hard plastics, ceramics, carbon fiber, and metals may be used. Examples include Incofoam®, Duocel®, metal and ceramic foams produced by American Elements®, and porous hard plastics such as polypropylene honeycombs and such. These structures must be similarly optimized to provide a compliant, tacky surface of low energy by coating as above.

The three-dimensional, open cellular structures above may be coated or may be directly reacted to form a compliant, tacky surface of low energy.

The three-dimensional, open cellular structure may itself form a compliant, tacky surface of low energy by, for example, forming such a structure directly from the coating polymers as described above. This is accomplished through methods of forming open-cell polymeric foams known to the art.

The structure may be in the form of sheets, cubes, spheres, or other shapes as well as densities (described by pores per inch and pore size distribution), and levels of tortuosity that optimize surface access, surface area, mineral attachment/detachment kinetics, and durability. These structures may be additionally optimized to target certain mineral particle size ranges, with denser structures acquiring smaller particle sizes. In general, cellular densities may range from 10-200 pores per inch, more preferably 30-90 pores per inch, and most preferably 30-60 pores per inch.

Figure 11:
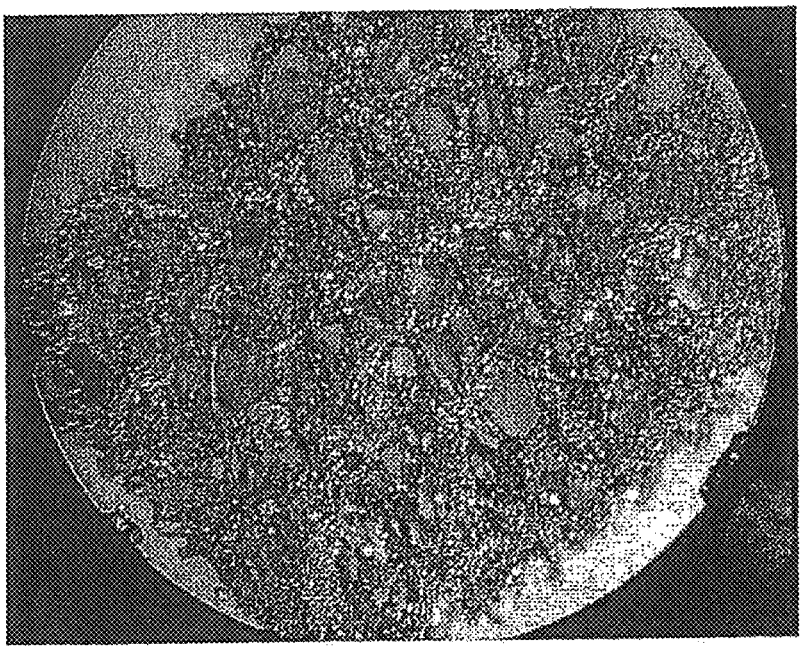
FIG. 11 shows a picture of reticulated foam with Cu mineral entrained throughout the structure.

The specific shape or form of the structure may be selected for optimum performance for a specific application. For example, the structure (coated foam for example) may be cut in a variety of shapes and forms. For example, a polymer coated foam belt could be moved through the slurry removing the desired mineral whereby it is cleaned and reintroduced into the slurry. Strips, blocks, and/or sheets of coated foam of varying size could also be used where they are randomly mixed along with the slurry in a mixing cell. Alternatively, a conveyor structure may be formed where the foam is encased in a cage structure that allows a mineral-containing slurry to pass through the cage structure to be introduced to the underlying foam structure where the mineral can react with the foam and thereafter be further processed in accordance with the present invention. The thickness and cell size could be changed to a form cartridge like filter whereby the filter is removed, cleaned of recovered mineral, and reused. FIG. 11 is an example a section of polymer coated reticulated foam that was used to recovery Chalcopyrite mineral. Mineral particles captured from copper ore slurry can be seen throughout the foam network.

There are numerous characteristics of the foam that may be important and should be considered:

Mechanical Durability:

Ideally, the foam will be durable in the mineral separation process. For example, a life of over 30,000 cycles in a plant system would be beneficial. As discussed above, there are numerous foam structures that can provide the desired durability, including polyester urethanes, reinforced urethanes, more durable shapes (spheres & cylinders), composites like PVC coated PU, and non-urethanes. Other potential mechanically durable foam candidate includes metal, ceramic, and carbon fiber foams and hard, porous plastics.

Chemical Durability:

The mineral separation process can involve a high pH environment (up to 12.5), aqueous, and abrasive. Urethanes are subject to hydrolytic degradation, especially at pH extremes. While the functionalized polymer coating provides protection for the underlying foam, ideally, the foam carrier system is resistant to the chemical environment in the event that it is exposed. Chemical and mechanical durability can be further enhanced by coating the foam with, for example, polyvinylchloride, and then coating that with the compliant, tacky polymer of low surface energy.

Adhesion to the Coating:

If the foam surface energy is too low, adhesion of the functionalized polymer coating to the foam may be difficult and it could abrade off. However, as discussed above, a low surface energy foam may be primed with a high energy primer prior to application of the functionalized polymer coating to improve adhesion of the coating to the foam carrier. Alternatively, the surface of the foam carrier may be chemically or mechanically abraded to provide "grip points" on the surface for retention of the polymer coating, or a higher surface energy foam material may be utilized. Also, the functionalized polymer coating may be modified to improve its adherence to a lower surface energy foam. Alternatively, the functionalized polymer coating could be made to covalently bond to the foam.

Surface Area:

Higher surface area provides more sites for the mineral to bond to the functionalized polymer coating carried by the foam substrate. There is a tradeoff between larger surface area (for example using small pore cell foam) and ability of the coated foam structure to capture mineral while allowing gangue material to pass through and not be captured, for example due to a small cell size that would effectively entrap gangue material. The foam size is selected to optimize capture of the desired mineral and minimize mechanical entrainment of undesired gangue material. Additionally, the thickness of the compliant, tacky polymer of low surface energy is important in capturing mineral particles and impacts the particle size collected, with very thin coatings collecting proportionally smaller particle size fractions and thicker coatings (to a certain maximum thickness) collecting additional large particle size fractions.

Cell Size Distribution:

Cell diameter needs to be large enough to allow gangue and mineral to be removed but small enough to provide high surface area. There should be an optimal cell diameter distribution for the capture and removal of specific mineral particle sizes.

Tortuosity:

Cells that are perfectly straight cylinders have very low tortuosity. Cells that twist and turn throughout the foam or are staggered have "tortuous paths" and yield foam of high tortuosity. The degree of tortuosity may be selected to optimize the potential interaction of a mineral particle with a coated section of the foam substrate, while not be too tortuous that undesirable gangue material in entrapped by the foam substrate.

Functionalized Foam:

It may be possible to covalently bond functional chemical groups to the foam surface. This could include covalently bonding the functionalized polymer coating to the foam or bonding small molecules to functional groups on the surface of the foam, thereby making the mineral-adhering functionality more durable.

The pore size (PPI—pores per inch) of the foam is an important characteristic which can be leveraged to improved mineral recovery and/or target a specific size range of mineral. As the PPI increases the specific surface area (SSA) of the foam also increases. A high SSA presented to the process increases the probability of particle contact which results in a decrease in required residence time. This in turn, can lead to smaller size reactors. At the same time, higher PPI foam acts as a filter due to the smaller pore size and allows only particles smaller than the pores to enter into its core. This enables the ability to target, for example, mineral fines over coarse particles or opens the possibility of blending a combination of different PPI foam to optimize recovery performance across a specific size distribution.

The Related Family

This application is also related to a family of nine PCT applications, which were all concurrently filed on 25 May 2012, as follows:

PCT application no. PCT/US12/39528, entitled "Flotation separation using lightweight synthetic bubbles and beads;"

PCT application no. PCT/US12/39524, entitled "Mineral separation using functionalized polymer membranes;"

PCT application no. PCT/US12/39540, entitled "Mineral separation using sized, weighted and magnetized beads;"

PCT application no. PCT/US12/39576, entitled "Synthetic bubbles/beads functionalized with molecules for attracting or attaching to mineral particles of interest," which corresponds to U.S. Pat. No. 9,352,335;

PCT application no. PCT/US12/39591, entitled "Method and system for releasing mineral from synthetic bubbles and beads;"

PCT application no. PCT/US/39596, entitled "Synthetic bubbles and beads having hydrophobic surface;"

PCT application no. PCT/US/39631, entitled "Mineral separation using functionalized filters and membranes," which corresponds to U.S. Pat. No. 9,302,270;"

PCT application no. PCT/US12/39655, entitled "Mineral recovery in tailings using functionalized polymers;" and PCT application no. PCT/US12/39658, entitled "Techniques for transporting synthetic beads or bubbles In a flotation cell or column," all of which are incorporated by reference in their entirety.

This application also related to PCT application no. PCT/US2013/042202, filed 22 May 2013, entitled "Charged engineered polymer beads/bubbles functionalized with molecules for attracting and attaching to mineral particles of interest for flotation separation," which claims the benefit of U.S. Provisional Patent Application No. 61/650,210, filed 22 May 2012, which is incorporated by reference herein in its entirety.

This application is also related to PCT/US2014/037823, filed 13 May 2014, entitled "Polymer surfaces having a siloxane functional group," which claims benefit to U.S. Provisional Patent Application No. 61/822,679, filed 13 May 2013, as well as U.S. patent application Ser. No. 14/118,984, filed 27 Jan. 2014, and is a continuation-in-part to PCT application no. PCT/US12/39631 (712-2.385//CCS-0092), filed 25 May 2012, which are all hereby incorporated by reference in their entirety.

This application also related to PCT application no. PCT/US13/28303, filed 28 Feb. 2013, entitled "Method and system for flotation separation in a magnetically controllable and steerable foam," which is also hereby incorporated by reference in its entirety.

This application also related to PCT application no. PCT/US16/57334, filed 17 Oct. 2016, entitled "Opportunities for recovery augmentation process as applied to molybdenum production," which is also hereby incorporated by reference in its entirety.

This application also related to PCT application no. PCT/US16/37322, filed 17 Oct. 2016, entitled "Mineral beneficiation utilizing engineered materials for mineral separation and coarse particle recovery," which is also hereby incorporated by reference in its entirety.

This application also related to PCT application no. PCT/US16/62242, filed 16 Nov. 2016, entitled "Utilizing engineered media for recovery of minerals in tailings stream at the end of a flotation separation process," which is also hereby incorporated by reference in its entirety.

The Scope of the Invention

It should be further appreciated that any of the features, characteristics, alternatives or modifications described regarding a particular embodiment herein may also be applied, used, or incorporated with any other embodiment described herein. In addition, it is contemplated that, while the embodiments described herein are useful for homogeneous flows, the embodiments described herein can also be used for dispersive flows having dispersive properties (e.g., stratified flow).

Although the invention has been described and illustrated with respect to exemplary embodiments thereof, the foregoing and various other additions and omissions may be made therein and thereto without departing from the spirit and scope of the present invention.

What is claimed is:

1. Apparatus comprising:

a container configured to hold a mixture comprising engineered collection media and a slurry containing mineral particles; and a movement mechanism configured to turn the container such that at least part of the mixture in an upper part of the container is caused to interact with at least part of the mixture in a lower part of container so as to enhance a contact between the engineered collection media and the mineral particles in the slurry, wherein the engineered collection media comprise collection surfaces functionalized with a chemical having molecules to attract the mineral particles to the collection surfaces so as to form mineral laden media in the mixture in said contact, wherein the container has a first side and an opposing second side, the first side having an input configured to receive the engineered collection media, the second side having an output configured to discharge the mineral laden media from the container.

2. The apparatus according to claim 1, wherein the movement mechanism is configured to rotate the container along a horizontal axis.

3. The apparatus according to claim 1, wherein the container further comprises another input configured to receive the slurry.

4. The apparatus according to claim 3, wherein the container further comprises another output for discharging ore residue.

5. The apparatus according to claim 4, wherein other output is arranged on the second side.

6. The apparatus according to claim 3, wherein the output is also configured to discharge ore residue together with the mineral laden media in a mixture onto a screen configured to separate the mineral laden media from the ore residue.

7. The apparatus according to claim 6, wherein the other input is arranged on the first side.

8. The apparatus according to claim 1, wherein the engineered collection media comprise synthetic bubbles or beads, and the chemical is selected from the group consisting of polysiloxanes, poly(dimethylsiloxane), hydrophobically-modified ethyl hydroxyethyl cellulose, polysiloxanates, alkylsilane and fluoroalkylsilane, and pressure sensitive adhesives with low surface energy.

9. The apparatus according to claim 8, wherein the synthetic bubbles or beads are made of an open-cell foam.

10. The apparatus according to claim 8, wherein the synthetic bubbles or beads have a substantially spherical shape.

11. The apparatus according to claim 8, wherein the synthetic bubbles or beads have a substantially cubic shape.

12. Apparatus according to claim 1, wherein the container comprises a tumbler cell divided into multiple chambers to create a staged recovery reactor.

13. Apparatus according to claim 12, wherein the multiple chambers are employed with a variety of media types and kinetics to create the staged recovery reactor.

14. Apparatus according to claim 12, wherein each of the multiple chambers is configured with a respective media type to create a respective stage in the staged recovery reactor.

15. Apparatus according to claim 12, wherein the multiple chambers are configured to address or process different particle sizes or particle liberation classes in the staged recovery reactor.

16. Apparatus according to claim 13, wherein the media shape, specific gravity, and size are used to control the velocity profile of the engineered collection media within the tumbler.

* * * * *